US005837064A

United States Patent [19]

Bowers

[11] Patent Number: 5,837,064

[45] Date of Patent: Nov. 17, 1998

[54] ELECTROSTATIC DISCHARGE PROTECTION OF STATIC SENSITIVE DEVICES CLEANED WITH CARBON DIOXIDE SPRAY

[75] Inventor: Charles W. Bowers, Torrance, Calif.

[73] Assignee: Eco-Snow Systems, Inc., Livermore, Calif.

[21] Appl. No.: 821,960

[22] Filed: Oct. 4, 1996

[51] Int. Cl.[6] ..... B08B 6/00

[52] U.S. Cl. ..... 134/6; 134/7; 134/72; 134/902; 451/38; 451/39; 451/75; 451/78; 451/102

[58] Field of Search ..... 451/75, 78, 38, 451/39, 102; 134/6, 7, 72, 902

[56] References Cited

U.S. PATENT DOCUMENTS

| | | | |
|---|---|---|---|
| 4,132,567 | 1/1979 | Blackwood | 134/1 |
| 4,535,576 | 8/1985 | Shukla et al. | 451/78 |
| 4,974,375 | 12/1990 | Tada et al. | 51/413 |
| 5,190,064 | 3/1993 | Aigo | 134/84 |
| 5,364,472 | 11/1994 | Heyns et al. | 134/6 |
| 5,409,418 | 4/1995 | Krone-Schmidt et al. | 451/75 |
| 5,421,766 | 6/1995 | Shank, Jr. | 451/102 |
| 5,480,563 | 1/1996 | Mitsumori et al. | 210/748 |
| 5,601,478 | 2/1997 | Mesher | 451/38 |
| 5,605,484 | 2/1997 | Bailey et al. | 445/59 |
| 5,628,463 | 5/1997 | Nakamura | 239/690 |
| 5,651,834 | 7/1997 | Jon et al. | 134/31 |

*Primary Examiner*—Lyle A. Alexander
*Assistant Examiner*—Sharidan Carrillo
*Attorney, Agent, or Firm*—R. Craig Armstron

[57] ABSTRACT

An apparatus and method that enhances removal of contaminating particles from surfaces of a static-sensitive components that are cleaned using a carbon dioxide cleaning spray produced by a jet spray gun. The apparatus has a programmable power supply that is connected to ground, to the static-sensitive component, and to the jet spray gun. The static-sensitive component is cleaned using the cleaning spray and the surface charge generated on the surface of the component or substrate is simultaneously monitored to determine the amount and polarity of the charge that is generated thereon. The programmable power supply then applies a reverse bias to the jet spray gun that is equal to and has the opposite polarity of the charge that is generated on the surface of the static-sensitive component or substrate, which neutralizes the charge generated on the surface of the component.

3 Claims, 1 Drawing Sheet

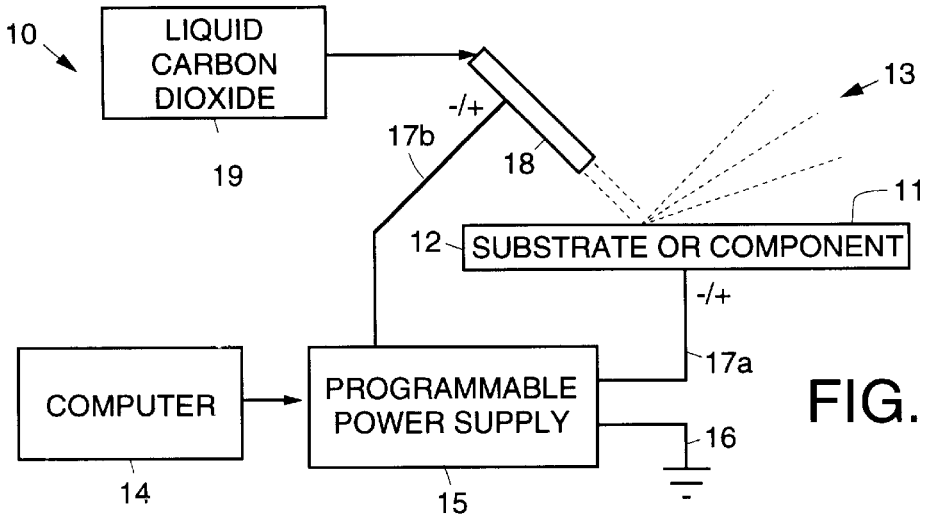
FIG. 1
FIG. 2
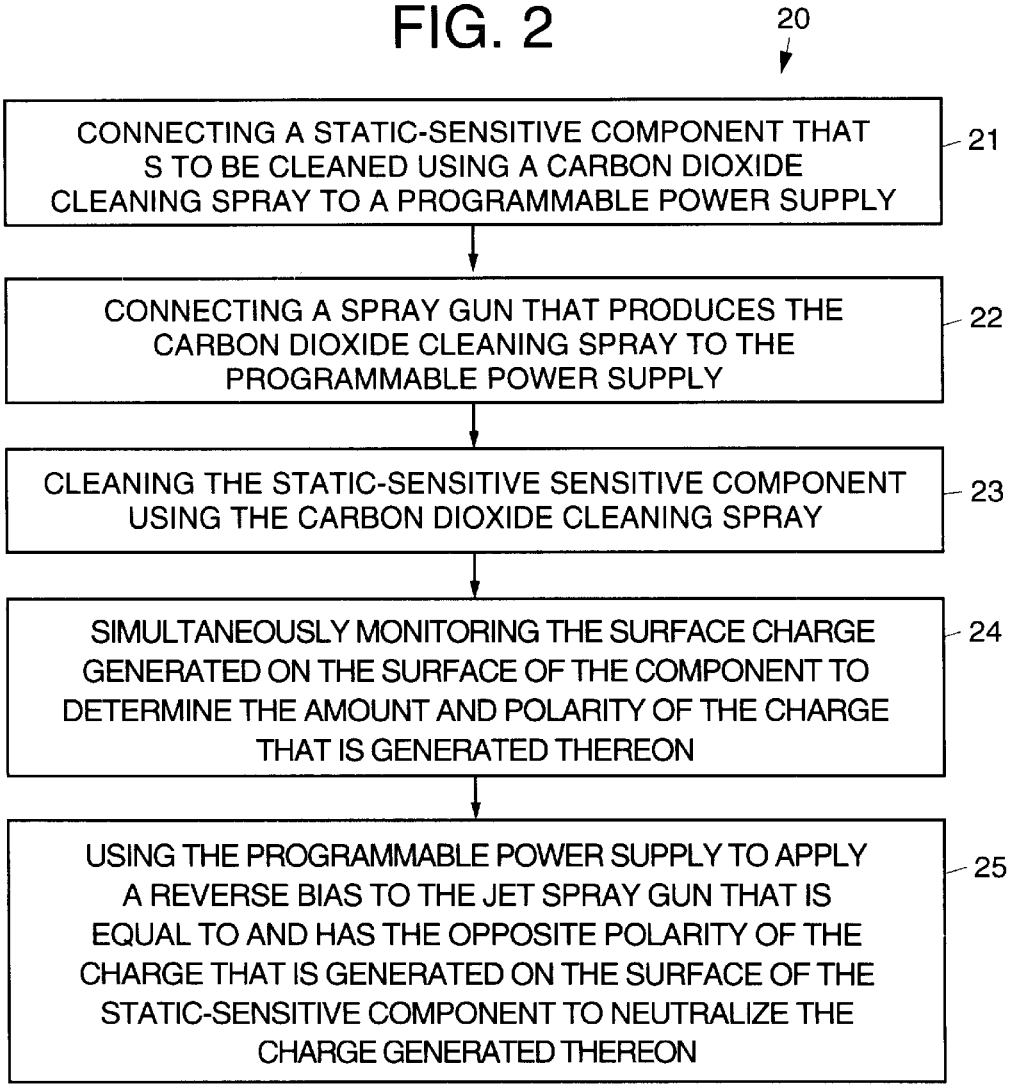

ELECTROSTATIC DISCHARGE PROTECTION OF STATIC SENSITIVE DEVICES CLEANED WITH CARBON DIOXIDE SPRAY

BACKGROUND

The present invention relates generally to cryogenic aerosol spray cleaning systems, and more particularly, to an apparatus and method for protecting static-sensitive devices from damage due to electrostatic discharge when they are cleaned using a carbon dioxide spray cleaning system.

The assignee of the present invention manufactures and sells carbon dioxide ($CO_2$) jet spray cleaning equipment under the ECO-SNOW™ brand. The carbon dioxide jet spray cleaning equipment uses a jet spray nozzle and orifice combination fed from a pressurized liquid carbon dioxide tank to generate a spray of $CO_2$ snow containing solid aerosol particles and gas. Selection of the particular nozzle and orifice combination and tank pressure determines the aggressiveness of the snow when it is used to clean surfaces contaminated with particulates.

It is known that cryogenic aerosol spray cleaners generate static charge on surfaces of components during cleaning. Unfortunately, the static charge buildup hinders removal of the contaminating particles from the surface of the component by the cryogenic aerosol spray. This is because the static charge buildup increases the attraction between the surface of the component and the contaminating particles that the cryogenic aerosol spray intends to remove. Furthermore, it is not desirable to increase the surface charge on static sensitive components, because they may be damaged by such charge. Typical static sensitive components include complementary metal oxide semiconductor (CMOS) devices and magnetoresistive read-write heads, for example. The CMOS devices have about a 50 volt sensitivity level, and the magnetoresistive read-write heads have about a 5 volt sensitivity level, and are thus very sensitive to electrostatic charge.

It is therefore desirable to eliminate the charge on static sensitive components during cryogenic aerosol spray cleaning. This is currently done during cryogenic aerosol spray cleaning with a shower of ions generated by a corona discharge system. The ability of the corona discharge system to remove static charge from the static sensitive component dictates how long the component may be sprayed before it must be allowed to "de-stat" in the shower of ions produced by the corona discharge system. This is not a very effective way to clean static sensitive components.

Accordingly, it is an objective of the present invention to provide an apparatus and method for protecting static-sensitive devices from damage due to electrostatic discharge when they are cleaned using a carbon dioxide spray cleaning system.

SUMMARY OF THE INVENTION

To meet the above and other objectives, the present invention provides for an apparatus and method that removes contaminating particles from a surface of a static-sensitive component or substrate that is cleaned using a carbon dioxide cleaning spray. The apparatus comprises a computer that is coupled to a programmable power supply that has one output coupled to ground, a second output coupled to a static-sensitive component that is to be cleaned using the carbon dioxide cleaning spray, and a third output coupled to a carbon dioxide spray gun used to clean the static-sensitive component. The present invention generates electrostatic charge that is used to balance the charge produced by the carbon dioxide spray during cleaning of the contaminated surface of the static-sensitive component.

The present invention biases the cleaning spray to compensate for the charging of the surface of the static-sensitive component by the carbon dioxide cleaning spray. This is achieved using a closed loop system wherein a computer monitors the surface of the static-sensitive component and controls charge supplied by a programmable power supply to the carbon dioxide spray gun. As the surface of the static-sensitive component starts to charge with respect to earth ground, the power supply is controlled to add opposite polarity charge to the carbon dioxide cleaning spray. This continuously compensates for any charge build-up and protects the static-sensitive component during cleaning.

It is necessary for the programmable power supply to be able to bias the surface of the static-sensitive component and the carbon dioxide cleaning spray both positively and negatively, because components charge in accordance with their relative positions on the Triboelectric scale relative to the position of the aerosol spray on the Triboelectric scale. Materials such as Teflon, for example, can have thousands of volts of static charge build-up after cleaning, while metals tend to have much less static charge build-up.

The present method comprises the following steps. A static-sensitive component that is to be cleaned using a carbon dioxide cleaning spray is connected to a programmable power supply. The carbon dioxide spray gun used to spray the carbon dioxide cleaning spray is also connected to the programmable power supply. The programmable power supply is connected to a computer that is used to monitor the charge build-up on the surface of the static-sensitive component caused by the cleaning spray when it impacts the surface. As the surface charge build-up on the static-sensitive component increases or decreases, the computer causes the programmable power supply to oppositely bias the spray gun, which induces an opposite charge on the spray gun, in response to the increase or decrease in surface charge build-up of the static-sensitive component. The relative amount of charge on the static-sensitive component is continuously monitored and the charge on the spray gun is reversed biased in an amount equal to the charge build-up on the static-sensitive component which compensates for the charge build-up and protects the static-sensitive component during cleaning.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 1 illustrates apparatus in accordance with the principles of the present invention that removes contaminating particles from a surface of a static-sensitive component or substrate that is cleaned using a carbon dioxide cleaning spray; and FIG. 2 illustrates one method of removing contaminating particles from a surface of a static-sensitive component that is cleaned using a carbon dioxide cleaning spray.

DETAILED DESCRIPTION

Referring to the drawing figures, FIG. 1 illustrates apparatus 10 in accordance with the principles of the present invention that removes contaminating particles from a surface 11 of a static-sensitive component 12 or substrate 12 that is cleaned using a carbon dioxide cleaning spray 13 produced by a jet spray gun 18. The carbon dioxide jet spray 13 generated by the jet spray gun 18 (or nozzle and orifice combination 18) fed from a pressurized liquid carbon dioxide tank 19 to generate a spray 13 of $CO_2$ snow containing solid aerosol particles and gas.

The cleaning spray 13 generates a charge on the surface 11 of the static-sensitive component 12 or substrate 12 during cleaning, which can adversely affect or damage the static-sensitive component 12 or substrate 12. The present invention minimizes or eliminates this charge build-up to permit complete cleaning of the surface 11 of the static-sensitive component 12 or substrate 12 without producing potentially harmful static charge thereon.

The apparatus 10 comprises a computer 14 that is coupled to a programmable power supply 15 that has its outputs 16, 17*a*, 17*b* respectively coupled to ground, to the static-sensitive component 12 or substrate 12 that is to be cleaned, and to the jet spray gun 18. The present invention monitors the static charge build-up on the static-sensitive component 12 and generates a reverse-biased electrostatic charge that is applied to the jet spray gun 18 that neutralizes the charge generated on the surface 11 of the contaminated component 12 or substrate 12 during spray cleaning.

The present invention must be able to bias the surface 11 of the component 12 or substrate 12 and the jet spray gun 18 both positively and negatively, because materials that make up the component 12 or substrate 12 charge according to their relative positions on the Triboelectric scale relative to the position of the carbon dioxide spray 13 on the Triboelectric scale. Materials such as Teflon, for example, may exhibit thousands of volts of static charge build-up after cleaning. In contrast, metals typically have much less static charge build-up.

FIG. 2 illustrates one method 20 of removing contaminating particles from a surface 11 of a static-sensitive component 12 or substrate 12 that is cleaned using a carbon dioxide cleaning spray 13. The present method 20 comprises the following steps.

A static-sensitive component 12 or substrate 12 that is to be cleaned is connected 21 to a programmable power supply 15. A jet spray gun 18 used to spray the carbon dioxide cleaning spray 13 is also connected 22 to the programmable power supply 15. The static-sensitive sensitive component 12 or substrate 12 is then cleaned 23 using the cleaning spray 13 and the surface charge generated on the surface 11 of the component 12 or substrate 12 is simultaneously monitored 24 to determine the amount and polarity of the charge that is generated thereon.

The programmable power supply 15 then caused to apply 25 a reverse bias to the jet spray gun 18 that is equal to and has the opposite polarity of the charge that is generated on the surface 11 of the static-sensitive sensitive component 12 or substrate 12. This application of reverse bias to the jet spray gun 18 neutralizes the charge generated on the surface 11 of the component 12 or substrate 12. The monitoring of the charge on the surface 11 of the static-sensitive component 12 or substrate 12 may be easily achieved in a routine manner by appropriately programming 25 of the computer 14. The amount of voltage or charge applied to the jet spray gun 18 depends upon the material from which the component 12 or substrate 12 is made.

Therefore, by monitoring the static charge build-up on the static-sensitive component 12 and generating a reverse-polarity electrostatic charge that is equal to the charge build-up that is applied to the jet spray gun 18, the charge generated on the surface 11 of the contaminated component 12 or substrate 12 during spray cleaning is neutralized. This allows cleaning of the component 12 or substrate 12 without causing damage thereto resulting from electrostatic charge build-up. This protects the static-sensitive component 12 or substrate 12 during cleaning.

Thus, an apparatus and method of enhancing the removal of contaminating particles on surfaces of an electrostatically sensitive components or substrates when they are cleaned using a carbon dioxide cleaning spray have been disclosed. It is to be understood that the described embodiments are merely illustrative of some of the many specific embodiments which represent applications of the principles of the present invention. For example, additional cryogenic aerosols such as nitrous oxide, argon and xenon may be used in certain applications instead of a carbon dioxide spray. Clearly, numerous and other arrangements can be readily devised by those skilled in the art without departing from the scope of the invention.

What is claimed is:

1. An apparatus for cleaning a surface of a static-sensitive component, said apparatus comprising:

a) a cleaning spray device for generating a carbon dioxide cleaning spray for cleaning the surface of the static-sensitive component, wherein said cleaning spray device statically generates a first charge on the surface of the static-sensitive component during cleaning; and b) a programmable power supply that has outputs respectively coupled to ground, to the static-sensitive component that is to be cleaned, and to the cleaning spray device, for selectively biasing the cleaning spray device with a second charge in an amount that is equal in magnitude to and opposite in polarity to the first charge generated during cleaning of the static-sensitive component by the cleaning spray device, wherein the second charge neutralizes the first charge on the static-sensitive component.

2. The apparatus of claim 1 further comprising a computer that is coupled to programmable power supply for monitoring build-up of the first charge on the static-sensitive component and for controlling the amount of bias applied to the cleaning spray device by the programmable power supply.

3. A method of cleaning a surface of a static-sensitive component using a cleaning spray device that generates a carbon dioxide cleaning spray, said method comprising:

a) providing a cleaning spray device for generating a carbon dioxide cleaning spray;

b) connecting a static-sensitive component to a programmable power supply;

c) connecting the cleaning spray device to the programmable power supply;

d) cleaning the surface of the static-sensitive component using the carbon dioxide cleaning spray;

e) generating a first charge on the surface of the static-sensitive component as a result of cleaning with the carbon dioxide cleaning spray;

f) monitoring the first charge to determine an amount and polarity of the first charge that is generated by the carbon dioxide cleaning spray; and g) applying a reverse bias to the cleaning spray device during cleaning of the static-sensitive component to produce a second charge which is equal in magnitude and opposite in polarity to the first charge, wherein said second charge neutralizes the first charge on the surface of the static-sensitive component.

* * * * *